US011105496B1

(12) United States Patent
Huang et al.

(10) Patent No.: US 11,105,496 B1
(45) Date of Patent: Aug. 31, 2021

(54) DOWNLIGHT APPARATUS HAVING A ROTATION UNIT AND SHIFTING UNIT FOR MOVING AND ROTATING LIGHT MODULE WITH RESPECT TO A HOST HOUSING

(71) Applicant: XIAMEN LEEDARSON LIGHTING CO. LTD, Fujian (CN)

(72) Inventors: Zhenkun Huang, Fujian (CN); Yongzhe Dong, Fujian (CN); Xiaoliang Wen, Fujian (CN); Shouqiang Hou, Fujian (CN); Huiyong Huang, Fujian (CN)

(73) Assignee: XIAMEN LEEDARSON LIGHTING CO. LTD, Xiamen (CN)

( * ) Notice: Subject to any disclaimer, the term of this patent is extended or adjusted under 35 U.S.C. 154(b) by 0 days.

(21) Appl. No.: 16/916,719

(22) Filed: Jun. 30, 2020

(51) Int. Cl.

| | |
|---|---|
| ***F21V 21/30*** | (2006.01) |
| ***F21V 17/00*** | (2006.01) |
| ***F21V 23/06*** | (2006.01) |
| ***F21V 21/40*** | (2006.01) |
| ***F21S 8/02*** | (2006.01) |
| ***F21V 14/06*** | (2006.01) |
| ***F21V 17/10*** | (2006.01) |
| *F21Y 115/10* | (2016.01) |

(52) U.S. Cl.
CPC ..... *F21V 21/30* (2013.01); *F21S 8/026* (2013.01); *F21V 14/06* (2013.01); *F21V 17/002* (2013.01); *F21V 17/105* (2013.01); *F21V 21/40* (2013.01); *F21V 23/06* (2013.01); *F21Y 2115/10* (2016.08)

(58) Field of Classification Search
CPC ..... F21S 8/026; F21V 14/06; F21V 21/30; F21V 21/26; F21V 21/28; F21Y 2115/10
See application file for complete search history.

(56) References Cited

U.S. PATENT DOCUMENTS

| | | | | |
|---|---|---|---|---|
| 6,837,596 | B2 * | 1/2005 | Tanaka | F21V 29/83 362/277 |
| 8,215,805 | B2 * | 7/2012 | Cogliano | F21V 21/04 362/366 |
| 8,226,278 | B2 * | 7/2012 | Ward | F21V 21/04 362/365 |

* cited by examiner

*Primary Examiner* — Robert J May
(74) *Attorney, Agent, or Firm* — Chun-Ming Shih; Lanway IPR Services

(57) ABSTRACT

A downlight apparatus includes a light module, a host housing, and a light module, a first rotation unit and a shifting unit. The light module includes a light housing and LED modules. The light housing defines a light opening for a light of the LED modules to escape. The host housing is used for fixing to an installation platform. For example, the installation platform may be a cavity on a ceiling or a junction box placed on a ceiling. The host housing defines a host opening. The first rotation unit is used for the light module attached to and manually rotated with respect to the host housing along a first axial line. The shifting unit is used for the light module moving with respect to the host housing with a variable exposed distance from the host opening.

18 Claims, 12 Drawing Sheets

DOWNLIGHT APPARATUS HAVING A ROTATION UNIT AND SHIFTING UNIT FOR MOVING AND ROTATING LIGHT MODULE WITH RESPECT TO A HOST HOUSING

FIELD

The present application is related to a downlight apparatus and more particularly related to a downlight apparatus with adjustable light direction.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Downlight devices are popular and widely used in various places. In past time, people just expect the downlight devices for illumination. Now, people hope downlight devices to provide more flexible settings for different circumstances to bring a more convenient user experience.

SUMMARY

In some embodiments, a downlight apparatus includes a light module, a host housing, and a light module, a first rotation unit and a shifting unit.

The light module includes a light housing and LED modules. The light housing defines a light opening for a light of the LED modules to escape.

The host housing is used for fixing to an installation platform. For example, the installation platform may be a cavity on a ceiling or a junction box placed on a ceiling. The host housing defines a host opening.

The first rotation unit is used for the light module attached to and manually rotated with respect to the host housing along a first axial line. The shifting unit is used for the light module moving with respect to the host housing with a variable exposed distance from the host opening.

Specifically, in addition for the light module to rotate with respect to the host housing, the light module may be pulled out with a desired distance from the host opening of the host housing so that the host housing does not block light of the light module.

In some embodiments, the downlight apparatus may also include a second rotation unit for the light module attached to and manually rotated along a second axial line.

In some embodiments, the first axial line is perpendicular to the second axial line.

In some embodiments, the shift unit provides the light module to move along a shifting direction in parallel with a housing axial line.

In some embodiments, the downlight apparatus may also include a U-shape structure including a horizontal bar and two vertical bars. The two vertical bars are connected at two opposite ends of the horizontal bar. The first rotation unit, the second rotation unit and the shifting unit are disposed on the U-shape structure.

In some embodiments, the host housing has a dome structure defining a container for storing the U-shape structure.

In some embodiments, the first rotation unit is disposed at a middle position of the horizontal bar.

In some embodiments, the second rotation unit is disposed at two ends of the vertical levers opposite to the two opposite ends of the horizontal bar.

In some embodiments, the shifting unit includes a sliding track for the light module to move along the sliding track to change the exposed distance from the host opening.

In some embodiments, the sliding track includes multiple elastic positioning units for keeping the light module staying in one of the elastic position unit when no external force is applied on the light module.

In some embodiments, the shifting unit is disposed on the horizontal bar.

In some embodiments, the shifting unit has two terminals respectively connecting to the horizontal bar and the host housing.

In some embodiments, the host housing has a connector for detachably connecting the U-shape structure. The U-shape structure and the light module is detached from the host housing to replace another light unit to the connector.

In some embodiments, the connector has a pair of magnet units respectively disposed on the host housing and the U-shape structure. A driving current is transmitted via the connector.

In some embodiments, the light module further includes a light cover. The light cover has multiple columns with reverse hook ends for inserting into corresponding slots to fix the light housing with the light cover.

In some embodiments, a lens module is clipped between the light cover and the light housing for changing directions of the light of the LED modules.

In some embodiments, the host housing has a connector for connecting the light module for transmitting a driving current to the LED modules of the light module.

In some embodiments, the first rotation unit includes a conductive path for routing the driving current to the LED modules.

In some embodiments, the downlight apparatus may also include a collectable handle attached to the light module for rotating and moving the light module with respect to the host housing.

In some embodiments, the downlight apparatus may also include a lens attached to the light housing with a lens adjustment unit. The lens adjustment unit is used for manually adjusting a beam angle of the light of LED modules output from the lens by changing a lens distance from the LED module.

DETAILED DESCRIPTION

Figure 10:
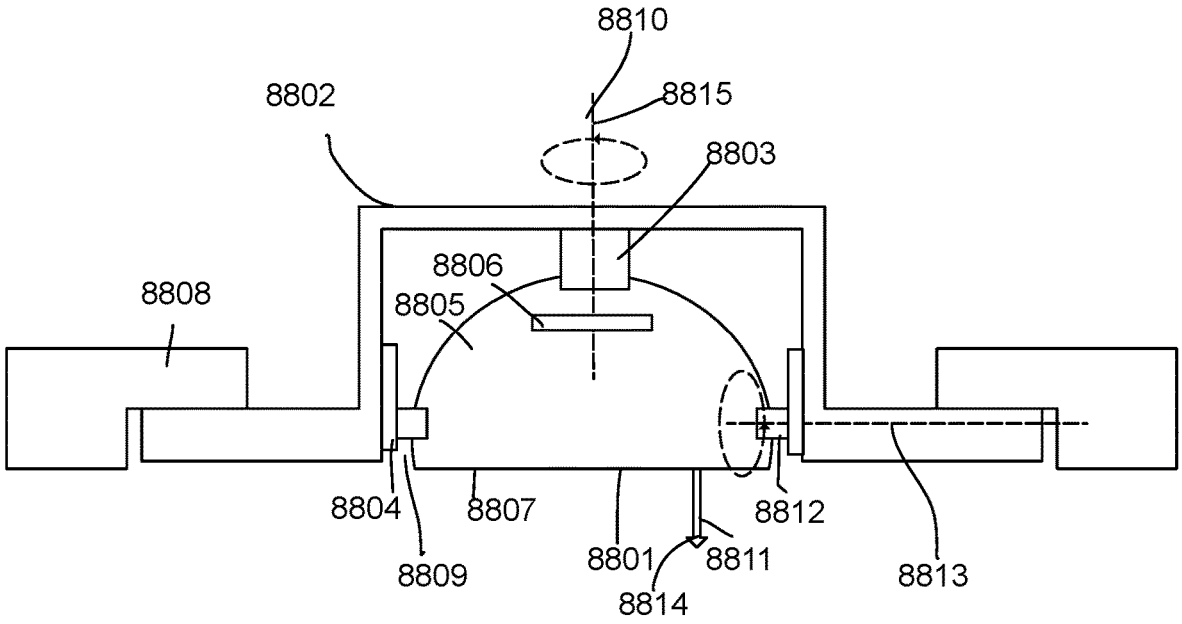
FIG. 10 illustrates a structural diagram of an embodiment.

In FIG. 10, a downlight apparatus includes a light module 8801, a host housing 8802, a first rotation unit 8803 and a shifting unit 8804.

The light module 8801 includes a light housing 8805 and LED modules 8806. The light housing 8805 defines a light opening 8807 for a light of the LED modules 8806 to escape.

The host housing 8802 is used for fixing to an installation platform 8808. For example, the installation platform 8808 may be a cavity on a ceiling or a junction box placed on a ceiling. The host housing 8802 defines a host opening 8809.

The first rotation unit 8803 is used for the light module 8801 attached to and manually rotated with respect to the host housing 8802 along a first axial line 8810. The shifting unit 8804 is used for the light module 8801 moving with respect to the host housing 8802 with a variable exposed distance 8811 from the host opening 8809.

Specifically, in addition for the light module 8801 to rotate with respect to the host housing 8802, the light module 8801 may be pulled out with a desired distance from the host opening 8809 of the host housing 8802 so that the host housing 8802 does not block light of the light module 8801 if needed.

In FIG. 10, the downlight apparatus may also include a second rotation unit 8812 for the light module 8801 attached to and manually rotated along a second axial line 8813.

In FIG. 10, the first axial line 8810 is perpendicular to the second axial line 8813.

In FIG. 10, the shift unit provides the light module to move along a shifting direction 8814 in parallel with a housing axial line 8815.

Figure 4:
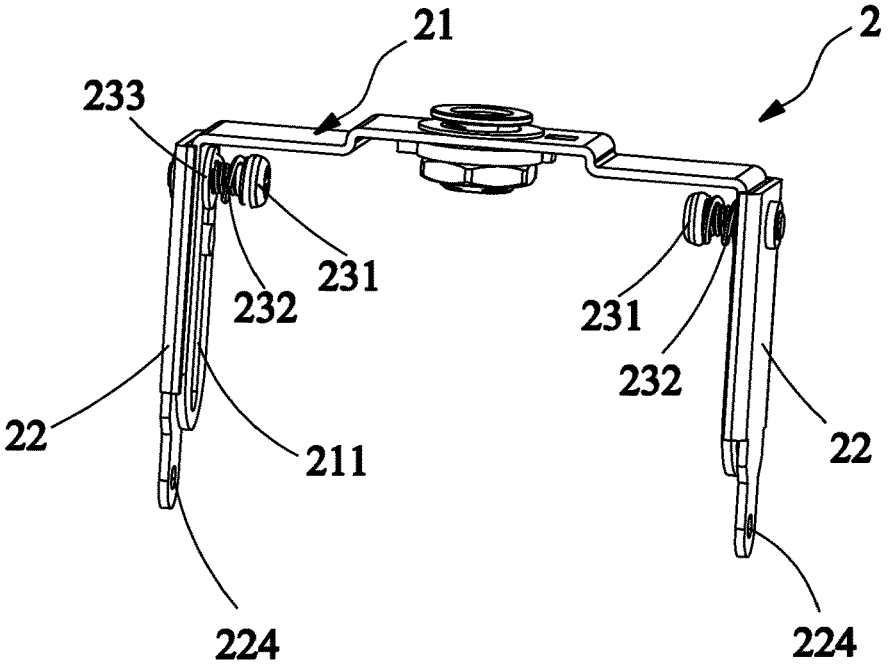
FIG. 4 illustrates a U-shape structure example.

In FIG. 4, the downlight apparatus may also include a U-shape structure 2 including a horizontal bar 21 and two vertical bars 22. The two vertical bars 22 are connected at two opposite ends of the horizontal bar 21. The first rotation unit, the second rotation unit and the shifting unit are disposed on the U-shape structure.

Figure 6:
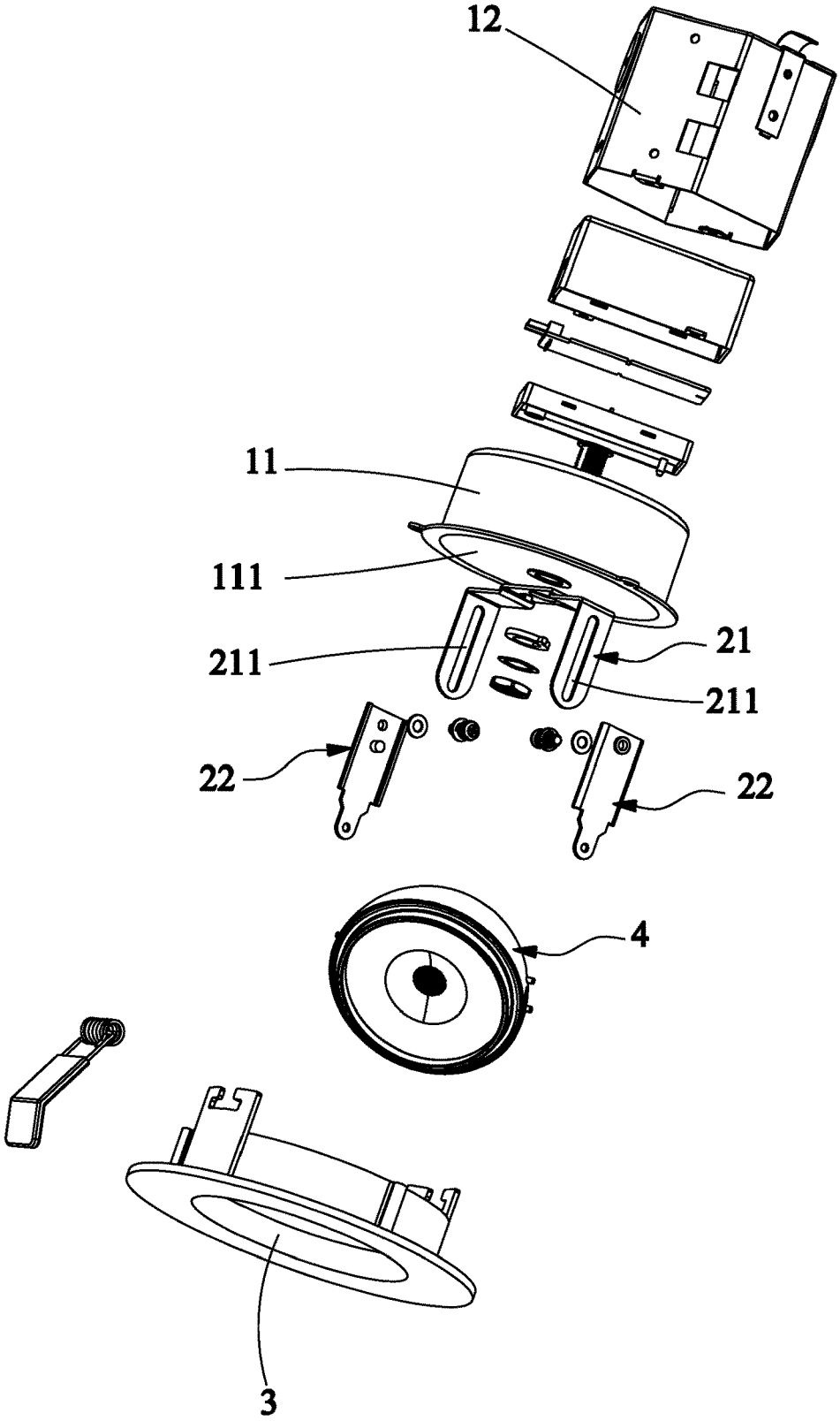
FIG. 6 illustrates an exploded view of the embodiment in FIG. 1.

In FIG. 6, the host housing has a dome structure 11 defining a container for storing the U-shape structure 21.

In FIG. 4, the first rotation unit 288 is disposed at a middle position of the horizontal bar 21.

In FIG. 4, the second rotation unit 224 is disposed at two ends of the vertical bars 224 opposite to the two opposite ends of the horizontal bar 21.

In FIG. 4, the shifting unit includes a sliding track 211 for the light module to move along the sliding track to change the exposed distance from the host opening.

Figure 11:
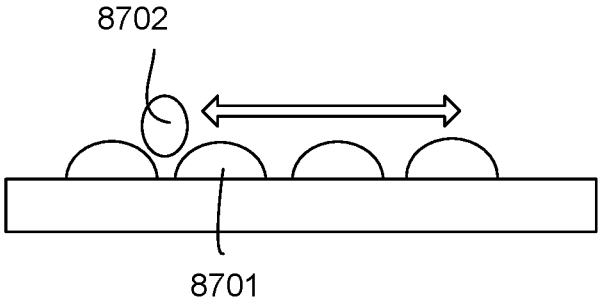
FIG. 11 illustrates a sliding track example.

In FIG. 11, the sliding track includes multiple elastic positioning units 8701, like elastic clips, for keeping the light module staying in one of the elastic position unit 8701 when no external force is applied on the light module when a corresponding block 8702 is placed on a track unit moving with respect to the sliding track.

Figure 12:
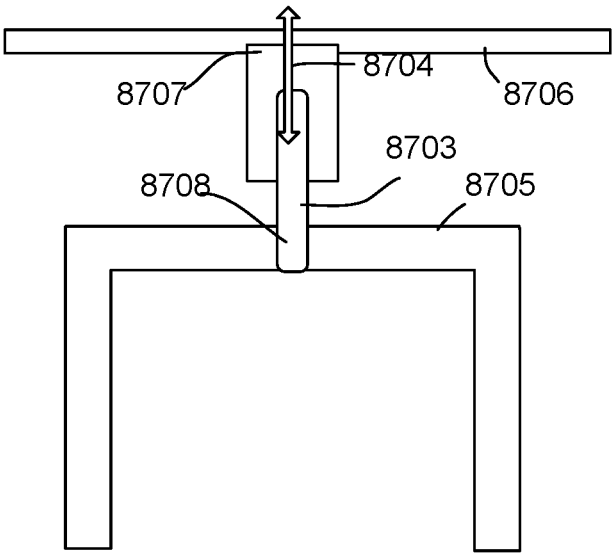
FIG. 12 shows electricity supplying structure.

In FIG. 12, the shifting unit 8704, like a track providing up-down shifting 8704 is disposed on the horizontal bar 8705. The first rotation unit may be integrated with the shifting unit 8704.

In FIG. 12, the shifting unit 8073 has two terminals 8708, 8707 respectively connecting to the horizontal bar 8705 and the host housing 8706.

Figure 13:
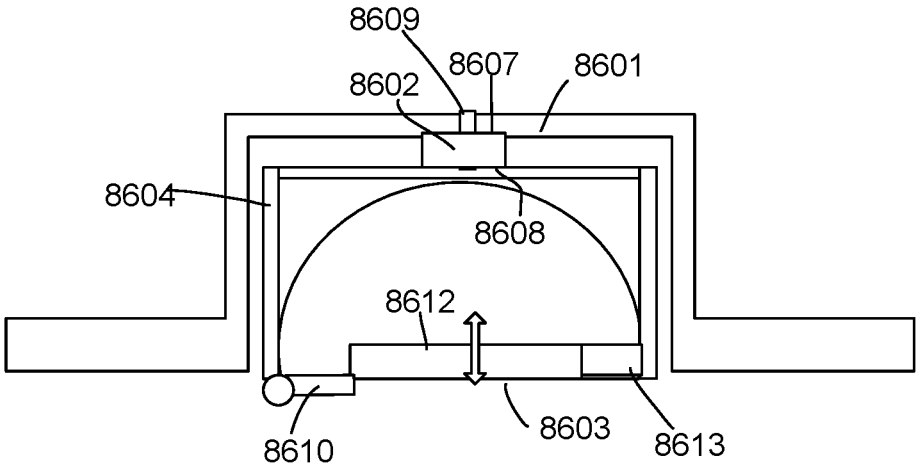
FIG. 13 shows another example.

In FIG. 13, the host housing 8601 has a connector 8602 for detachably connecting the U-shape structure 8604. The U-shape structure 8604 and the light module 8603 is detached from the host housing 8601 to replace another light unit to the connector 8602.

In some embodiments, the connector has a pair of magnet units 8607, 8608 respectively disposed on the host housing 8601 and the U-shape structure 8604. A driving current is transmitted via the connector 8602.

Figure 9:
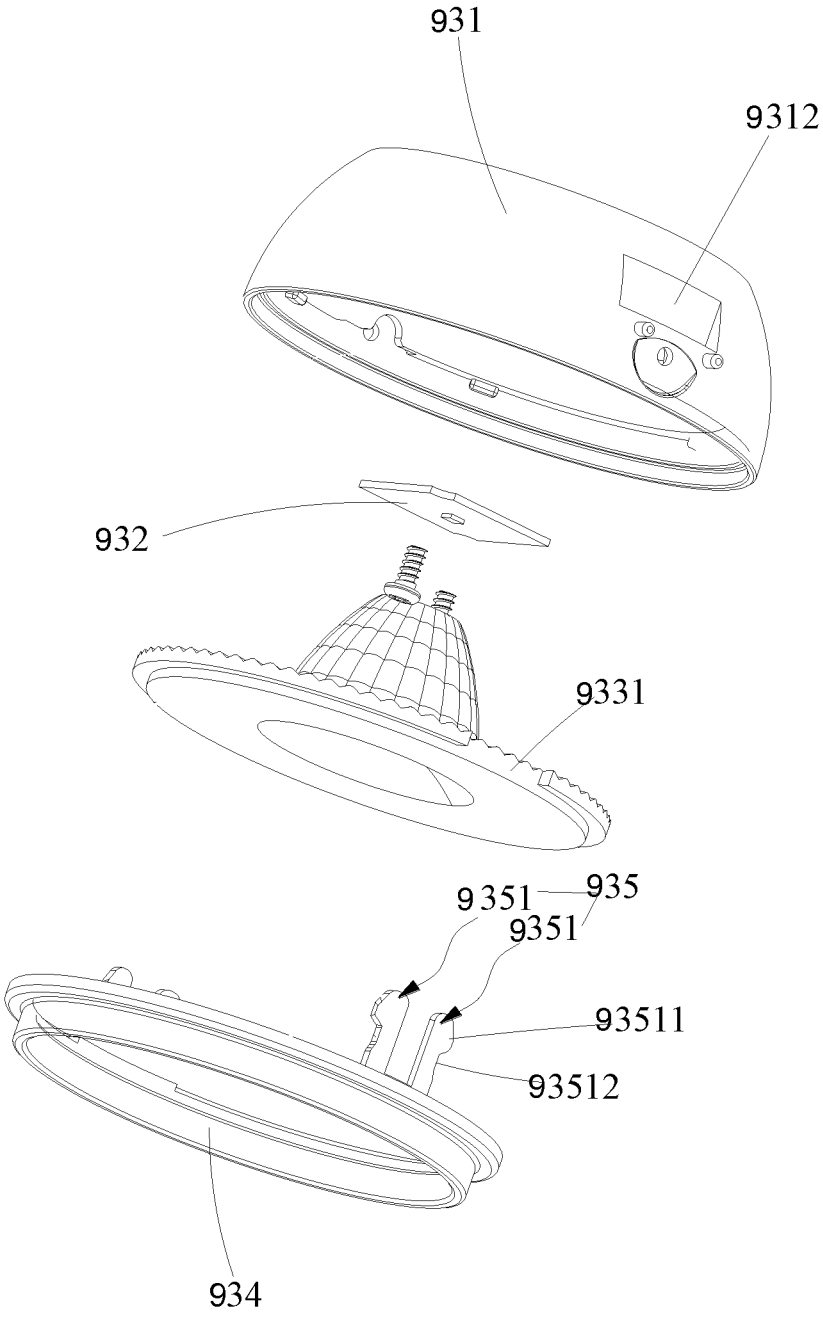
FIG. 9 illustrates a light body example.

In FIG. 9, the light module further includes a light cover 934. The light cover 934 has multiple columns 93512 with reverse hook ends 935, 93511 for inserting into corresponding slots 9312 to fix the light housing 931 with the light cover 934.

In FIG. 9, a lens module 9331 is clipped between the light cover 934 and the light housing 931 for changing directions of the light of the LED modules 932.

In some embodiments, the host housing has a connector for connecting the light module for transmitting a driving current to the LED modules of the light module.

In FIG. 13, the first rotation unit includes a conductive path 8609 for routing the driving current to the LED modules.

In FIG. 13, the downlight apparatus may also include a collectable handle 8610, e.g. a foldable handle, attached to the light module for rotating and moving the light module with respect to the host housing.

In FIG. 13, the downlight apparatus may also include a lens 8612 attached to the light housing with a lens adjustment unit 8613. For example, the lens 8612 is attached to rotatable screw structure to adjust a relative distance with respect to the LED modules to change a light beam angle. The lens adjustment unit is used for manually adjusting a beam angle of the light of LED modules output from the lens by changing a lens distance from the LED module.

In FIG. 1 to FIG. 6, a downlight apparatus 1 includes a host housing 11, a driver box 12, a surface rim 3, a shifting unit 2, and a light body 4. The driver box 12 contains a driver 12 for converting an external power to a driving current.

The shifting unit 2 includes a horizontal bar 21 and two vertical bars 22. The two vertical bars 22 are connected at two opposite ends of the horizontal bar 21. There is a pair of holes 224 at two ends of the two vertical bars opposite to the two opposite ends of the horizontal bar. The pair of holes 224 are used for inserting rotating shafts forming the second rotation unit. The screw units 231, 232, 233 may be used for fastening the sliding tracks 211.

Figure 1:
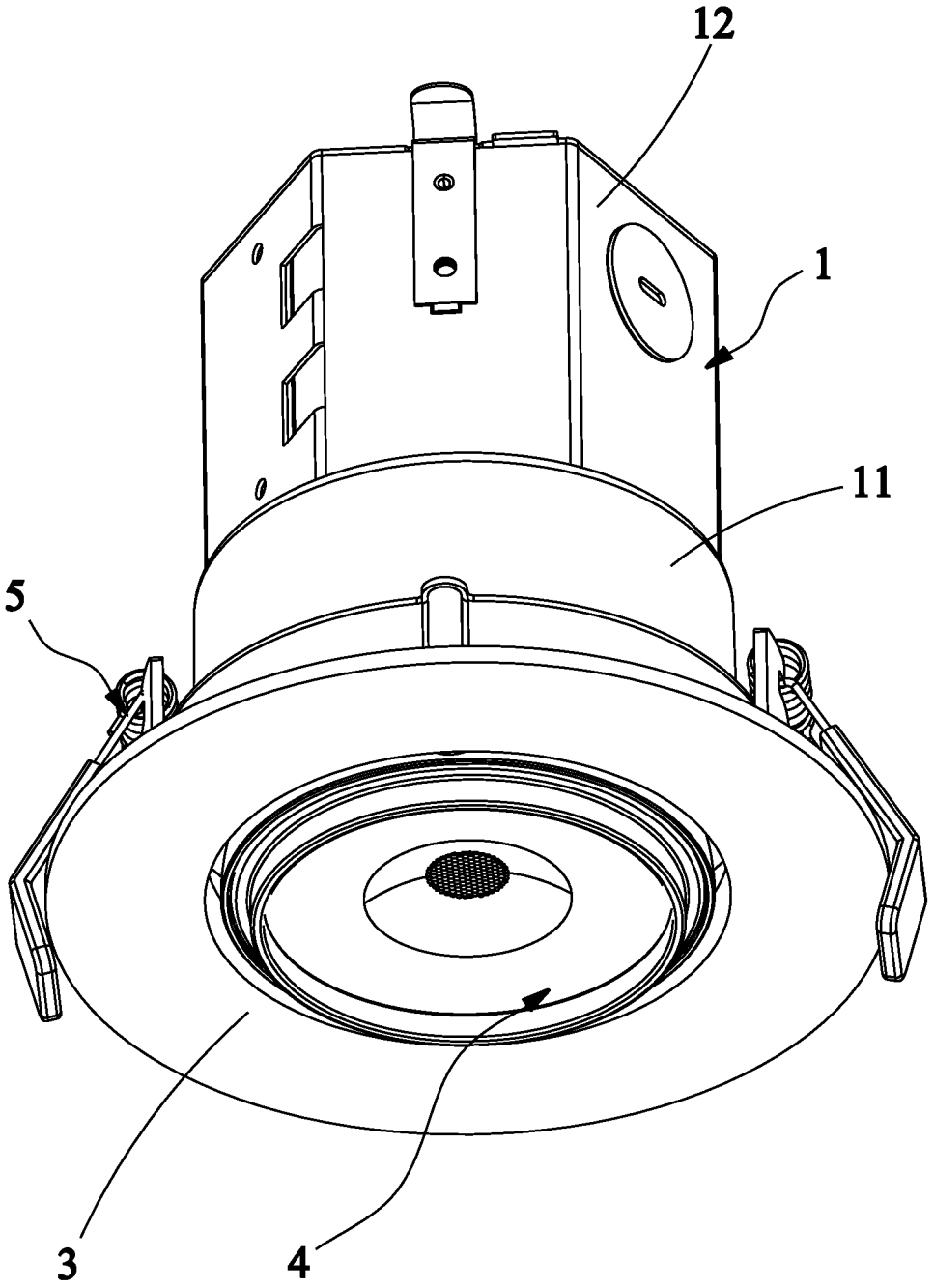
FIG. 1 illustrates a downlight apparatus embodiment.
Figure 2:
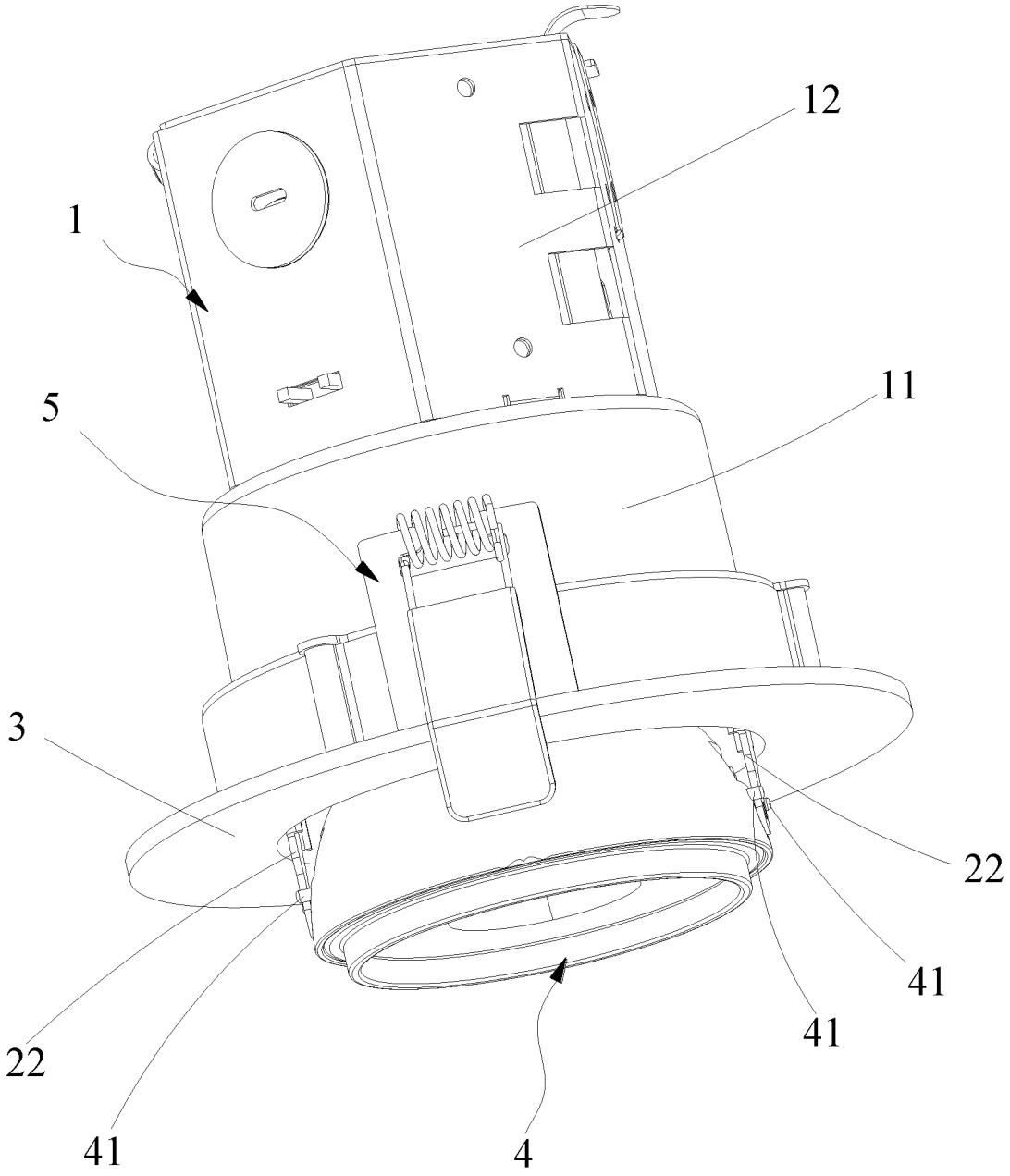
FIG. 2 illustrates another view of the example in FIG. 1.

As shown in FIG. 1 and FIG. 2, the light body may be pulled out so that the host housing does not affect light output. However, users may determine whether or not to pull out the light body, including how much to be exposed from the host opening.

In addition to the movement, there are two rotations allowing users to change the direction to 360 degrees along the axial line of the host housing and tilt angles.

Figure 5:
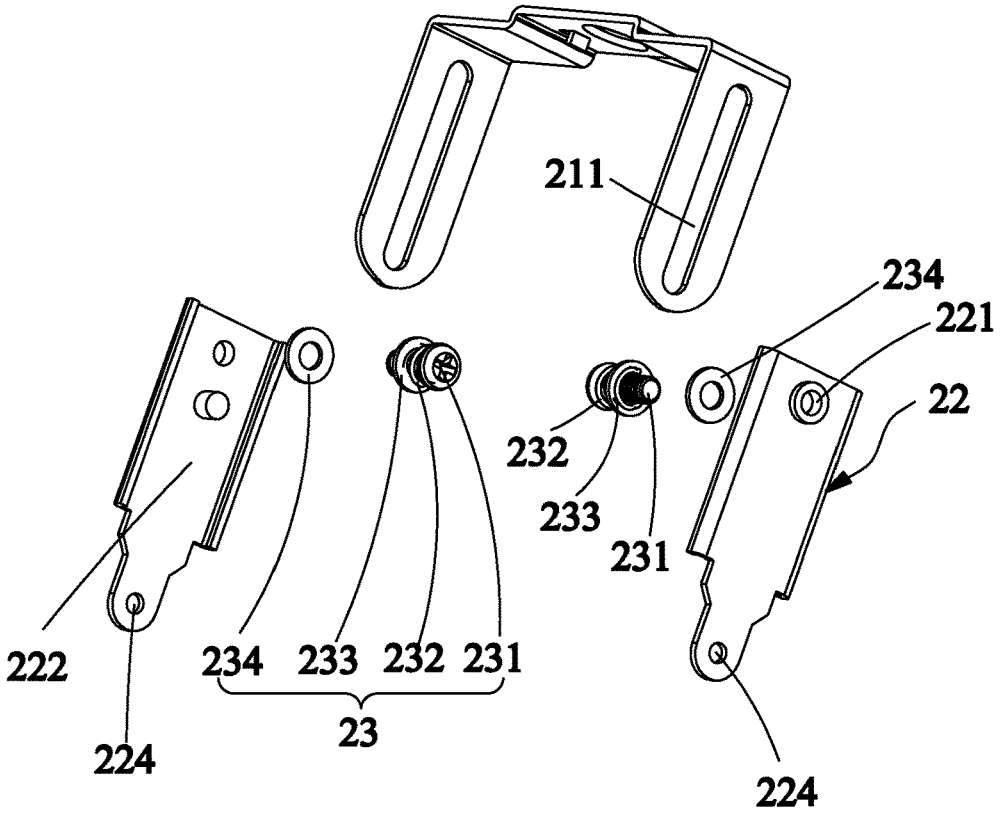
FIG. 5 illustrates an exploded structure of the U-shape structure in FIG. 4.

In FIG. 5, the shifting unit 2 also includes a fastener 23 including screw units 221, 231, 232, 233, 234.

Figure 3:
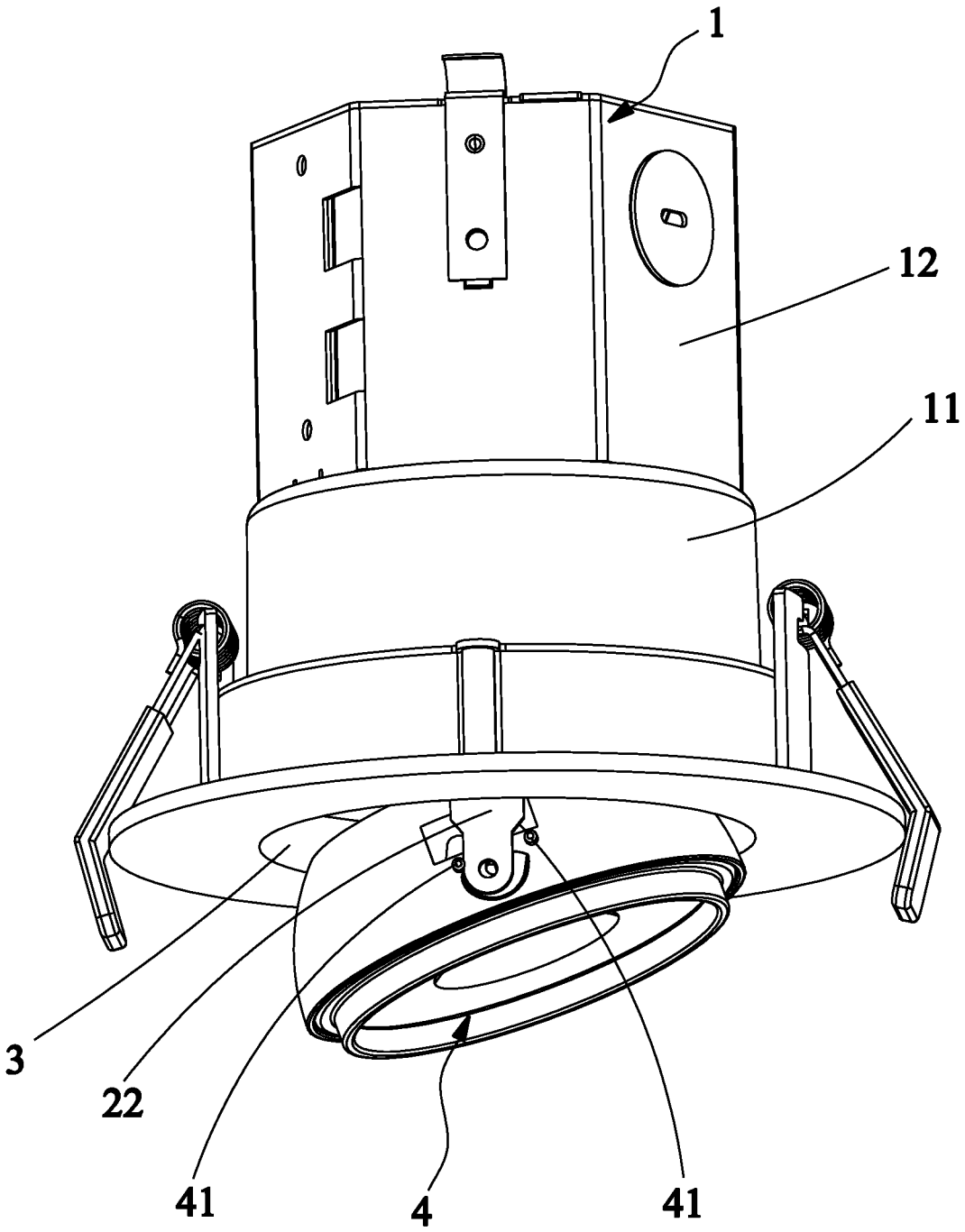
FIG. 3 illustrates a pulling-out status of the example in FIG. 1.

In FIG. 3, the columns 41 of the vertical bars provide rotating shafts for rotating the light body 4.

Figure 7:
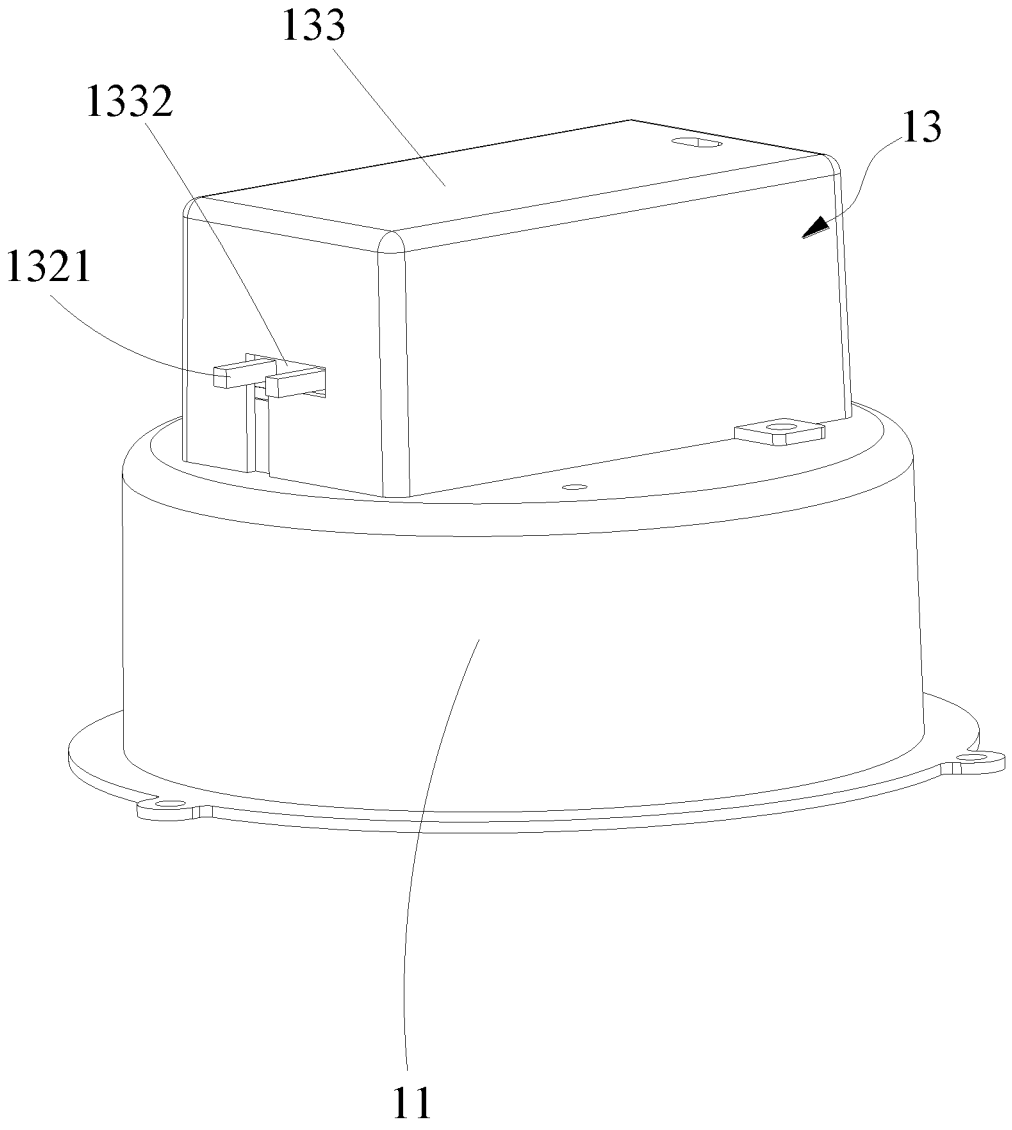
FIG. 7 illustrates a driver box example.
Figure 8:
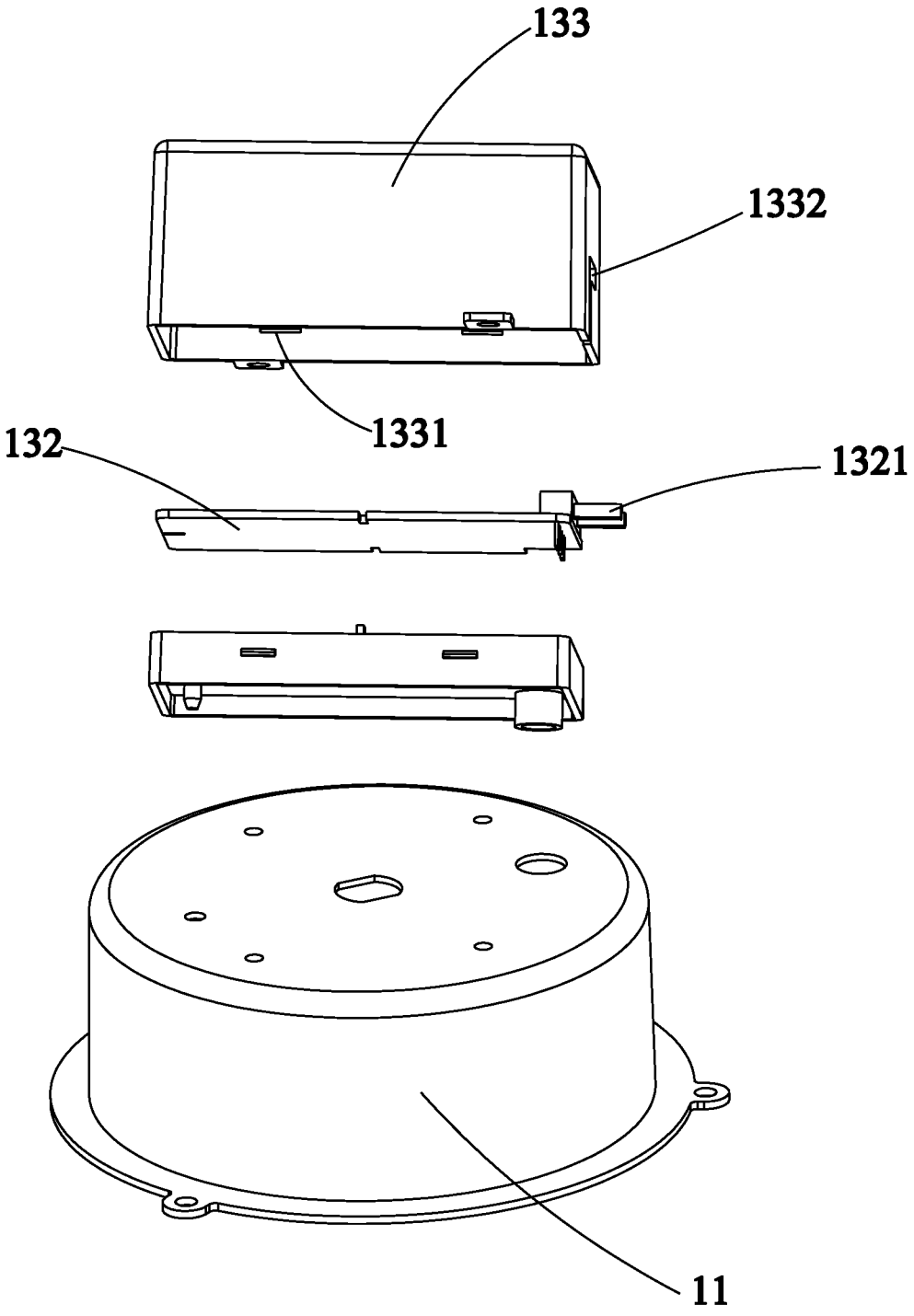
FIG. 8 illustrates an exploded view of the driver box example in FIG. 7.

In FIG. 7 and FIG. 8, the driver bottom cover 131 has a protruding buckle 1313. The driver top cover 133 has a buckle groove 1331 corresponding to the protruding buckle 1313.

The driver circuit 132 has a color temperature switch 1321. The driver top cover 133 has adjusting escape hole 1332.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a light module comprising a light housing and LED modules, the light housing defining a light opening for a light of the LED modules to escape;

a host housing for fixing to an installation platform, the host housing defining a host opening;

a first rotation unit for the light module attached to and manually rotated with respect to the host housing along a first axial line;

a shifting unit for the light module moving with respect to the host housing with a variable exposed distance from the host opening a second rotation unit for the light module attached to and manually rotated along a second axial line; and a U-shape structure comprising a horizontal bar and two vertical bars, the two vertical bars being connected at two opposite ends of the horizontal bar, wherein the first rotation unit, the second rotation unit and the shifting unit are disposed on the U-shape structure.

2. The downlight apparatus of claim 1, wherein the first axial line is perpendicular to the second axial line.

3. The downlight apparatus of claim 1, wherein the shift unit provides the light module to move along a shifting direction in parallel with a housing axial line of the host housing.

4. The downlight apparatus of claim 1, wherein the host housing has a dome structure defining a container for storing the U-shape structure.

5. The downlight apparatus of claim 1, wherein the first rotation unit is disposed at a middle position of the horizontal bar.

6. The downlight apparatus of claim 1, wherein the second rotation unit is disposed at two ends of the vertical bars opposite to the two opposite ends of the horizontal bar.

7. The downlight apparatus of claim 1, wherein the shifting unit comprises a sliding track for the light module to move along the sliding track to change the exposed distance from the host opening.

8. The downlight apparatus of claim 1, wherein the sliding track comprises multiple elastic positioning units for keeping the light module staying in one of the elastic position unit when no external force is applied on the light module.

9. The downlight apparatus of claim 1, wherein the shifting unit is disposed on the horizontal bar.

10. The downlight apparatus of claim 9, wherein the shifting unit has two terminals respectively connecting to the horizontal bar and the host housing.

11. The downlight apparatus of claim 1, wherein the host housing has a connector for detachably connecting the U-shape structure, the U-shape structure and the light module is detached from the host housing to replace another light unit to the connector.

12. The downlight apparatus of claim 11, wherein the connector has a pair of magnet units respectively disposed on the host housing and the U-shape structure, a driving current is transmitted via the connector.

13. The downlight apparatus of claim 1, wherein the light module further comprises a light cover, the light cover has multiple columns with reverse hook ends for inserting into corresponding slots to fix the light housing with the light cover.

14. The downlight apparatus of claim 13, wherein a lens module is clipped between the light cover and the light housing for changing directions of the light of the LED modules.

15. The downlight apparatus of claim 1, wherein the host housing has a connector for connecting the light module for transmitting a driving current to the LED modules of the light module.

16. The downlight apparatus of claim 15, wherein the first rotation unit comprises a conductive path for routing the driving current to the LED modules.

17. The downlight apparatus of claim 1, further comprising a collectable handle attached to the light module for rotating and moving the light module with respect to the host housing.

18. The downlight apparatus of claim 1, further comprising a lens attached to the light housing with a lens adjustment unit, the lens adjustment unit being used for manually adjusting a beam angle of the light of LED modules output from the lens by changing a lens distance from the LED module.

* * * * *